US011437761B2

(12) United States Patent
Zhang

(10) Patent No.: US 11,437,761 B2
(45) Date of Patent: Sep. 6, 2022

(54) HIGH-CURRENT PLUG-IN CONNECTOR COMPONENTS AND HIGH-CURRENT PLUG-IN CONNECTOR

(71) Applicant: Beijing Senzhao Technology Co., Ltd., Beijing (CN)

(72) Inventor: Yifei Zhang, Beijing (CN)

(73) Assignee: BEIJING SENZHAO TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 17/089,793

(22) Filed: Nov. 5, 2020

(65) Prior Publication Data

US 2021/0143583 A1 May 13, 2021

(30) Foreign Application Priority Data

Nov. 8, 2019 (CN) ..... 201911088353.0

(51) Int. Cl.
*H01R 13/646* (2011.01)
*H01R 43/02* (2006.01)

(52) U.S. Cl.
CPC ..... *H01R 13/646* (2013.01); *H01R 43/02* (2013.01)

(58) Field of Classification Search
CPC ..... H01R 43/02; H01R 43/048; H01R 43/16; H01R 43/0585; H01R 43/00; H01R 4/723; H01R 4/20; H01R 4/187; H01R 4/186; H01R 4/18; H01R 4/024; H01R 13/646; H01R 13/504; H01R 4/625; H01R 4/62; H01R 4/206; H01R 2101/00; H01R 4/00; H01R 4/02; H01R 4/021; H01R 4/022; H01R 4/023; H01R 4/029; H01R 4/183; H01R 4/60; H01R 13/5045; H01R 13/5808; H01R 24/20; H01R 25/00; H01R 25/003; H01R 43/0235; H01R 43/0207
See application file for complete search history.

(56) References Cited

U.S. PATENT DOCUMENTS 4,405,195 A * 9/1983 Cherry ..... H01R 13/193 439/825
4,553,809 A * 11/1985 Holt ..... H01R 4/024 174/84 R (Continued)

*Primary Examiner* — Renee S Luebke
*Assistant Examiner* — Matthew T Dzierzynski
(74) *Attorney, Agent, or Firm* — McClure, Qualey & Rodack, LLP

(57) ABSTRACT

The present invention relates to a high-current plug-in connector component and a high-current plug-in connector. The high-current plug-in connector component comprises a plug body provided with a center hole and a cable connecting hole in an inner cavity thereof, a silver cap which is welded to an outer side of an opening of the center hole, an elastic rubber arranged in the center hole, and a preset soldering tin arranged at a bottom of an inner side of the cable connecting hole, wherein the plug is slotted into three to six petals so that the plug is expanded to form an expansion plug; a head of the high-current plug-in connector component and a heel part of the plug are in a plugging engagement with a socket component of a corresponding plug-in connector, so that the high-current plug-in connector component is in electrical contact with corresponding plug-in connector component.

10 Claims, 4 Drawing Sheets

(56) References Cited

U.S. PATENT DOCUMENTS

| | | | | | |
|---|---|---|---|---|---|
| 4,780,097 | A * | 10/1988 | Piscitelli | H01R 13/187 | 29/510 |
| 5,951,337 | A * | 9/1999 | Brake | H01R 13/17 | 439/825 |
| 6,250,974 | B1 * | 6/2001 | Kerek | H01R 13/187 | 439/843 |
| 6,328,615 | B1 * | 12/2001 | Safai | H01R 13/03 | 439/825 |
| 7,695,331 | B2 * | 4/2010 | Kerner | H01R 4/72 | 439/877 |
| 8,851,940 | B2 * | 10/2014 | Friedhof | H01R 13/187 | 439/843 |
| 8,926,361 | B2 * | 1/2015 | Oduca | H01R 13/24 | 439/519 |
| 9,331,400 | B1 * | 5/2016 | Bianca | H01R 13/05 | |
| 9,917,390 | B1 * | 3/2018 | Bianca | H01R 13/111 | |
| 11,101,589 | B2 * | 8/2021 | Gartenmaier | H01R 13/44 | |
| 2015/0255885 | A1 * | 9/2015 | Choi | H01R 43/02 | 439/874 |
| 2017/0229793 | A1 * | 8/2017 | Schmidt | H01R 43/048 | |

* cited by examiner

HIGH-CURRENT PLUG-IN CONNECTOR COMPONENTS AND HIGH-CURRENT PLUG-IN CONNECTOR

TECHNICAL FIELD

The invention belongs to the technical field of electrical connection, in particular to a high-current plug-in connector component and a high-current plug-in connector.

BACKGROUND TECHNOLOGY

An electrical connector is an essential component of measurement, control and various electrical devices. There are hundreds of millions of its related applications on the market every year. Its main performance depends on the contact resistance of the connection and the reliability of electrical connection is directly related to the reliability of electrical equipment and even personal safety.

At present, the plug-in connectors on the market can be divided into ordinary connectors and high-current connectors according to the current range. With the popularization of electric vehicles and the widespread use of high-power batteries, those applications such as fast charging connections for electric vehicles and mode switching of high-power rechargeable battery need higher current and power, thereby having more stringent requirements for the reliability of the large current connection as the connection reliability is directly related to the safety of equipment and personnel.

Due to the process and materials, the performance of the existing high-current plug-in connectors tends to gradually deteriorate over time, and the contact resistance of the high-current plug-in connectors doubles or even increases by 10 times so that the heat generation of connecting part increases during high-current operation, thereby directly endangering the safety of using equipment, even the safety of person.

Based on the above problems, the present invention discloses a plug-in connector component, which improves the contact resistance of the high-current plug-in connector and can provide a stable and reliable high-current plug-in connector for the electrical application market.

SUMMARY OF THE INVENTION

In view of the above, the embodiments of the present invention provide a high-current plug-in connector component and a high-current plug-in connector to solve the problems in the prior art like the existing high-current plug-in connectors have a large contact resistance, the performance tends to gradually deteriorate and the contact resistance increases exponentially over time, which would endangers the safety of using equipment, even the safety of person.

To achieve the above objective, the present invention provides the following technical solutions:

One aspect of the present invention involves a high-current plug-in connector component comprising a plug body provided with a center hole and a cable connecting hole in an inner cavity thereof, a silver cap welded to an outer side of an opening of the center hole, a heel part of the plug, an elastic rubber arranged in the center hole, and a preset soldering tin arranged at a bottom of an inner side of the cable connecting hole, wherein a head of the high-current plug-in connector component is in a plugging engagement with a corresponding plug-in connector component, so that the high-current plug-in connector component is in electric contact with the corresponding plug-in connector component which is an unthreaded-hole socket; and the center hole is located at a center of the plug of the high-current plug-in connector component, the cable connecting hole is located at a tail end of the plug body of the high-current plug-in connector components and used to weld corresponding cable with the preset soldering tin, so that the high-current plug-in connector component is in electrical contact with the corresponding cable.

Preferably, the plug body is made of pure copper material, the silver cap is made of pure silver material, and the elastic rubber is made of pure rubber material; a diameter of the center hole is a half of that of the plug body, and a diameter of the cable connecting hole is the same as that of a copper core of the corresponding cable.

Preferably, a plug end section, a sliver cap welding section, a transition section, an intermediate plug member, the transition section between the silver cap welding section and the intermediate plug member, a conical connecting section at the heel part of the plug, a plug reinforcement column member and a plug tail end member are successively provided along the plug body from the head to the tail end.

Preferably, the heel part of the plug is provided with a conical surface, and a diameter of a larger end of the conical surface is bigger than a diameter of a corresponding socket hole, so that the heel part of the plug is in electrical contact with the socket after the plug is inserted into the socket.

Preferably, the silver cap has a hollow structure; a necking section of the silver cap is provided on an outer side of the silver cap, and a welding section is provided in an inner cavity thereof; the welding section is welded to the silver cap welding section at the plug body; after the welding is completed, the head of the plug is slotted into three to six petals, and a diameter of the head of the plug is appropriately expanded to form an expansion plug.

Preferably, the elastic rubber is of a solid structure and is successively provided with a head member, a transition part, and a tail member, the transition part being between the head member and the tail member.

Another aspect of the present invention involves a high-current plug-in connector component further comprising a cable which is welded by the preset soldering tin of the high-current plug-in connector component so as to be electrically connected with the high-current plug-in connector component, and an unthreaded-hole socket which is in a plugging engagement with the high-current plug-in connector component.

Preferably, the unthreaded-hole socket comprises a socket body which is arranged with a welding hole and a screw hole in an inner cavity thereof, and an external thread and a conical connecting surface on an outer side thereof; a silver liner is welded in the welding hole; a copper power strip is in plugging connection to the socket body by the conical connecting surface of the socket body; a detachable nut is connected to the socket body by the external thread; by rotating the detachable nut, the conical connecting surface of the socket body is separated from the connected conical surface; by inserting the head of the high-current plug-in connector into the silver liner of the unthreaded-hole socket, the conical connecting surface at the heel part of the plug of the high-current plug-in connector component could be embedded in the silver liner of the unthreaded-hole socket, thereby realizing engagement between the high-current plug-in connector component and the socket body.

Preferably, the socket body is made of pure copper material.

Preferably, a mounting conical surface and a mounting screw hole are provided in an inner cavity of the copper power strip, and the conical connecting surface of the socket body is inserted into the mounting conical surface of the copper power strip so that most part of the conical connecting surface of the socket body is embedded in the mounting conical surface of copper power strip, thereby realizing a connection between the socket body and the cooper power strip.

The invention has the following beneficial effects: the high-current plug-in connector component according to embodiments of the present invention could greatly reduce the contact resistance of corresponding high-current plug-in connector and multiply its current carrying capacity. Further, the high-current plug-in connector component according to embodiments of the present invention shows a stable and reliable performance in a long term, which solves the problems in the prior art such as, the existing high-current plug-in connectors have a large contact resistance, the performance tends to gradually deteriorate and the contact resistance increases exponentially over time, thereby endangering the safety of using equipment, even the safety of person.

Additional aspects and advantages of the present invention will be given in the following description section, which will become apparent from the description below or be known through the practice of the present invention.

DESCRIPTION OF THE DRAWINGS

In order to explain the technical solutions in the embodiments of the present invention more clearly, the following will briefly introduce the drawings that need to be used in the description of the embodiments or the prior art. Obviously, the drawings in the following description are only some embodiments of the present invention. For those of ordinary skill in the art, other drawings can be obtained based on these drawings without creative work.

Figure 1:
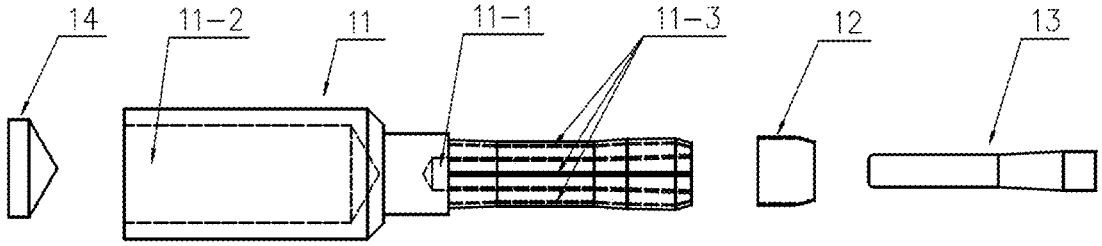
FIG. 1 is a schematic diagram of the high-current plug-in connector component according to the present invention.

In the drawings: 11-3 are petals slotted at the plug head; 28 is an end surface of the conical connecting section at the heel part of the plug; 58 is an end surface of the conical section of the plug body; 59 is an end surface of the socket; 81 is a silver cap welded on the plug head; 82 is the plug head; 83 is a conical connecting section between the plug and the socket; 84 is a heel part of the conical section of the plug; 85 is a central hole at the plug head; 86 is a tail end of the plug; and 87 is a cable connecting hole at the tail end of the plug.

EMBODIMENTS

Core of the present invention is to provide a high-current plug-in connector component and a high-current plug-in connector to solve the deficiencies of high-current plug-in connectors in the prior art such as, poor current carrying capability, bulkiness, performance deterioration and total connection resistance of high-current plug-in connectors increase over the time, which endangers equipment safety and even personal safety.

In order to specifically describe the above-mentioned high-current plug-in connector component, specific embodiments are used for description below.

As shown in FIG. 1, which is a schematic diagram of the high-current plug-in connector component according to the present invention, the high-current plug-in connector component is a plug engaging with corresponding plug-in connector components by plugging. Specifically it comprises a plug body (11), a heel part of plug, a sliver cap (12), an elastic rubber (13) and a preset soldering tin (14). The plug body (11) is provided with a center hole and a cable connecting hole in an inner cavity thereof, the silver cap (12) is welded to an outer side of an opening of the center hole, the elastic rubber (13) is arranged in the center hole and able to offer auxiliary elastic force for an expansion plug, and the preset soldering tin (14) is arranged at a bottom of an inner side of the cable connecting hole. During machining, a diameter of the center hole is configured to be one-half of a diameter of the plug body (11), and a diameter of the cable connecting hole is the same as a diameter of a copper core of a corresponding connecting cable. The heel part of the plug is provided with a conical section, and a diameter of a larger end of the conical section is bigger than a diameter of the corresponding socket hole, so that the heel part of the plug is in electrical contact with the socket after the plug is inserted into the socket.

Hereinto, a head end of the high-current plug-in connector component is in a plugging engagement with a socket component of the corresponding plug-in connector, so that the high-current plug-in connector component is in electric contact with the corresponding plug-in connector component; most of a conical connecting section of the plug heel part (25) is inserted into the socket hole so that the conical section of the plug heel is in contact with the socket, and the high-current plug-in connector component comprises an unthreaded-hole socket. The center hole is located at the center of the plug among the high-current plug-in connector component, the cable connecting hole is located at one end of the plug of high-current plug-in connector component and configured for welding cables with the preset soldering tin (14), so that the high-current plug-in connector component is integrated and electrical contact with the corresponding cable, thereby reducing the connection resistance between the high-current plug-in connector component and the corresponding cable.

Specifically, the plug body (11) is made of pure copper, and provided with a center hole for installing the elastic rubber (13) at one end and a connecting hole for establishing electrical contact with the cable at another end. As the plug body (11) is made of pure copper, the resistivity thereof is much smaller than that of the elastic transition connector of the traditional high-current plug-in connector, thus reducing the contact resistance of connection between the plug and the socket, and thereby reducing total connection resistance of the high-current plug-in connector.

Specifically, the silver cap (12) is made of pure silver, and the existing high-current plug-in connector adopts a silver-plated elastomer which over time the plating layer tends to wear and surface begins to oxidize, resulting in a higher contact resistance between the pull-in connector component and the unthreaded-hole socket, and the silver cap (12) in the present invention is made of pure silver material, instead of silver-plated elastomer, thereby avoiding the possibility that the contact resistance becomes larger.

Specifically, the elastic rubber (13) plays an auxiliary function. The elastic rubber (13) is installed in the center hole to provide auxiliary elastic force for the high-current plug-in connector component, thereby ensuring a reliable connection between the high-current plug-in connector component and the unthreaded-hole socket. In the existing high-current plug-in connector, the contact force reduces due to elastic force reduction of the expansion plug, which causes the contact resistance between the high-current plug-in connector component and the unthreaded-hole socket to increase. The elastic rubber (13) adopted in the present invention could play an auxiliary function and improve the situation where the contact resistance becomes larger.

Specifically, the high-current plug-in connector component is connected to the cable through a soldering tin which is a preset soldering tin arranged at the bottom of the inner side of the cable connecting hole. After pressing the cable in position, heat the preset soldering tin until melting to merge high-current plug-in connector component with the cable. Upon long term use, cables in existing high-current plug-in connector components turn to oxidize, and in the effect of penetration, the connection resistance between the high-current plug-in connector component and the cable is increased. However, by welding the cable with soldering tin, the present invention avoids the above mentioned situation, and ensures the stability and reliability of the connection resistance in long-term use.

It can be seen from the above description that use of the high-current plug-in connector components provided by embodiments of the present invention greatly reduces total connection resistance of the corresponding high-current plug-in connector, doubles the current passage capability of the corresponding high-current plug-in connector, and is stable and reliable in long-term use, which solves the problem that performance of the existing high-current plug-in connectors gradually deteriorates over time and contact resistance increases exponentially, thereby endangering equipment safety and even personal safety.

Figure 2:
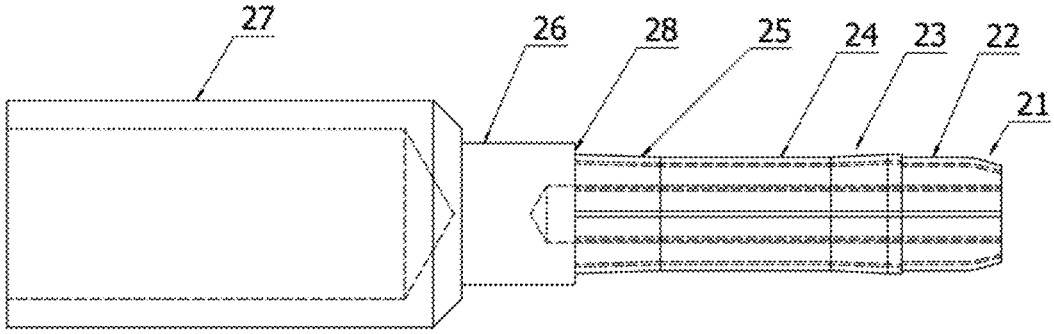
FIG. 2 is a schematic diagram of the plug body according to the present invention.

Further, as shown in FIG. 2, which is a schematic diagram of the plug body of the invention, the plug body (11) from the head end to the tail is successively provided with a plug end section (21), a sliver cap welding section (22), a transition section (23) an intermediate plug member (24), the transition section (23) between the silver cap welding section (22) and the intermediate plug member (24), a conical connecting section at the heel part of the plug (25), a plug reinforcement column member (26) and a plug tail end member (27).

Specifically, the plug end section (21) is used to facilitate plugging engagement of the high-current plug-in connector component with the corresponding unthreaded-hole socket; the silver cap welding section (22) is used to facilitate welding the silver cap (12) on the plug body (11); a diameter of the transition section (23) is less than that of a hole of the unthreaded-hole socket by about 0.05 mm, so as to avoid excessive inserting and pulling force due to lack of a margin during the insertion and engagement. A diameter of the intermediate plug member (24) is less than that of the silver inner liner of the unthreaded-hole socket, so as to avoid excessive inserting and pulling force due to lack of a margin during the insertion and engagement. A maximum diameter of the conical connecting section (25) at the heel part of the plug is larger than that of the silver inner liner of the unthreaded-hole socket by about 0.2 mm, so that both the head end and the heel part of the high-current plug-in connector component are in contact with the socket when the high-current plug-in connector component is inserted, thereby reducing the contact resistance between the high-current plug-in connector component and the unthreaded-hole socket. After inserting the high-current plug-in connector component into the unthreaded-hole socket, the plug reinforcement column member (26) rests against an installation insulating body for installing the unthreaded-hole socket, to provide a support, to avoid plug of the high-current plug-in connector components bend when a thick cable is connected in the effect of gravity. And the plug tail end member (27) is made of pure copper material, so as to reduce the body resistance of the high-current plug-in connector component so that the connection resistance of corresponding high-current plug-in connector is reduced.

Figure 3:
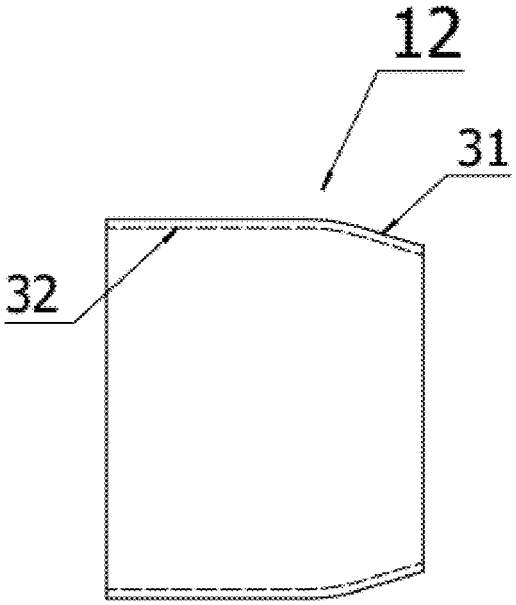
FIG. 3 is a schematic diagram of the silver cap according to the present invention.
Figure 8:
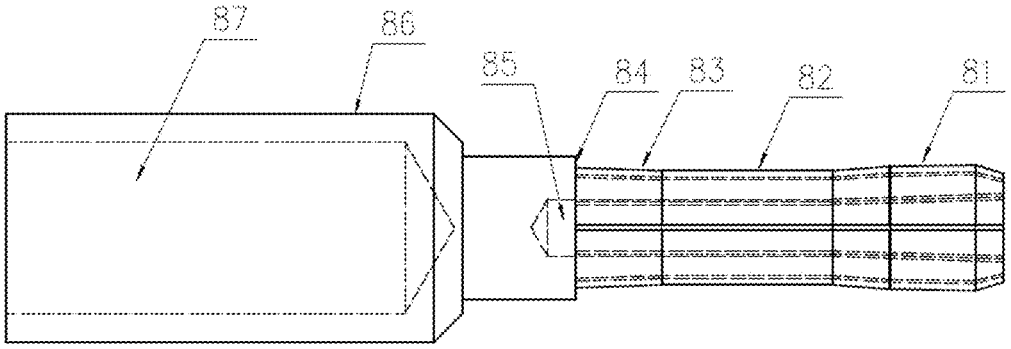
FIG. 8 is a schematic diagram showing that the head of the plug is slotted into three petals.

Furthermore, as is shown in FIG. 3, which is a schematic diagram of the silver cap (12) according to the present invention, the silver cap (12) is a hollow structure, and a silver cap necking section (31) is provided outside the silver cap (12), and a welding section (32) is provided inside, the welding section (32) is welded to the silver cap welding section (22) in the plug body (11), and furthermore, after welding the welding section (32) to the silver cap welding section (22), open three to six slots in the opening end, to divide the opening end to three or six parts, and extend the diameter at the opening end larger to be an expansion plug, as shown in FIG. 8, which is a schematic diagram of a plug wherein the plug head has been divided into three petals. A good electrical connection is promised when a silver cap (12) is welded to the plug head of the high-current plug-in connector component, and while contact resistance of existing high-current plug-in connector becomes bigger and bigger as its part oxidizes, by using the silver cap (12), the high-current plug-in connector components according to the present invention avoids bigger contact resistance due to oxidation accompanying long time engagement and use.

Figure 4:
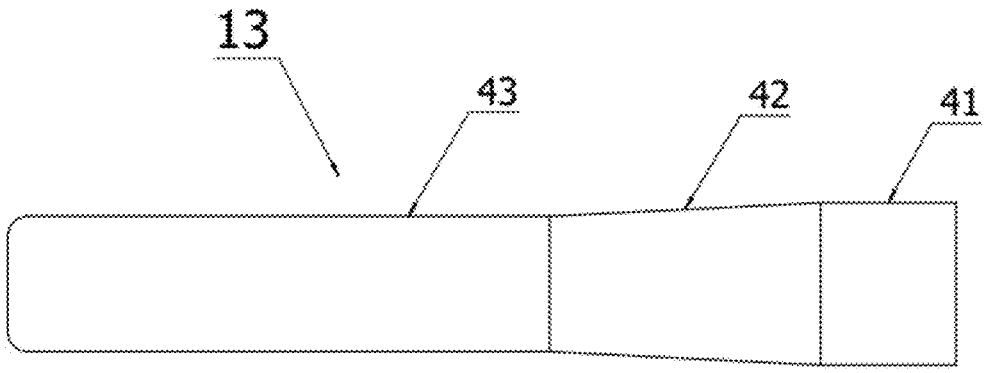
FIG. 4 is a schematic diagram of the elastic rubber according to the present invention.

Further, as shown in FIG. 4 which is a schematic diagram of the elastic rubber (13) according to the invention, the elastic rubber (13) is a solid integral structure, and provided with a head member (41), a tail member (42) and a transition part (43) between the head member (41) and the tail member (42). The elastic rubber (13) arranged in the center hole of the high-current plug-in connector component provides an auxiliary elastic force for the expansion plug and ensures a good electrical contact. Specifically, after the sliver cap (12) is welded at the plug head, the plug body (11) is slotted and the plug head expands while the intermediate plug member remains unchanged. A diameter of the expanded plug head is about 0.3 to 0.5 mm larger than that of the silver inner liner of the unthreaded-hole socket, thereby forming an expanded plug, which is a processing method of the high-current plug-in connector.

Figure 5:
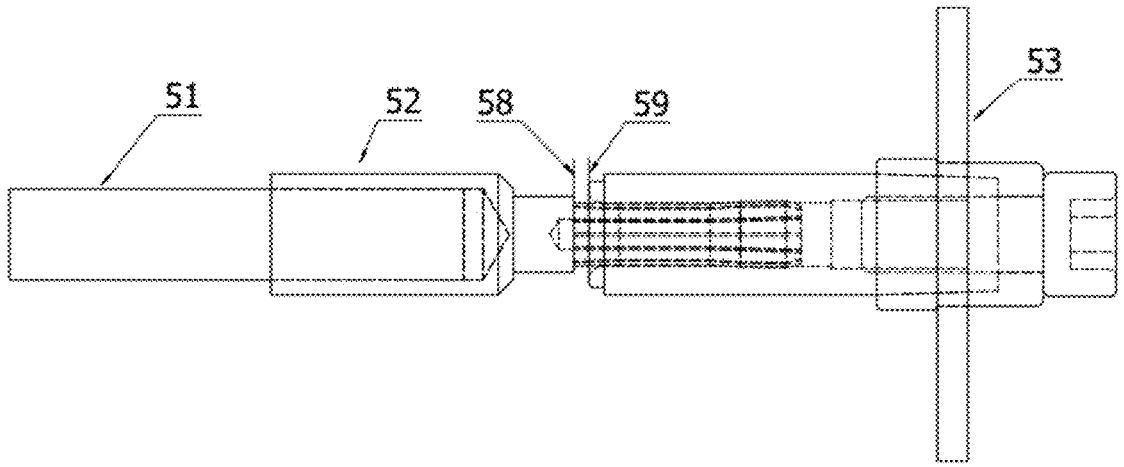
FIG. 5 is a schematic diagram of the high-current plug-in connector according to the present invention.

The present invention further discloses a method for connecting the high-current plug-in connector, as shown in FIG. 5, which is a schematic diagram of the high-current plug-in connector according to the present invention, the high-current plug-in connector of the present invention further comprises a plug component (51) of the high-current plug-in connector according to the present invention, which is inserted into the sliver inner liner of the socket body of the high-current plug-in connector, and further comprises a cable which is welded by the soldering tin of the high-current plug-in connector component so as to be in electrical contact with the high-current plug-in connector component, and the present invention further comprises a copper power strip (53) with unthreaded-hole sockets which are in a plugging engagement with the high-current plug-in connector component.

Figure 6:
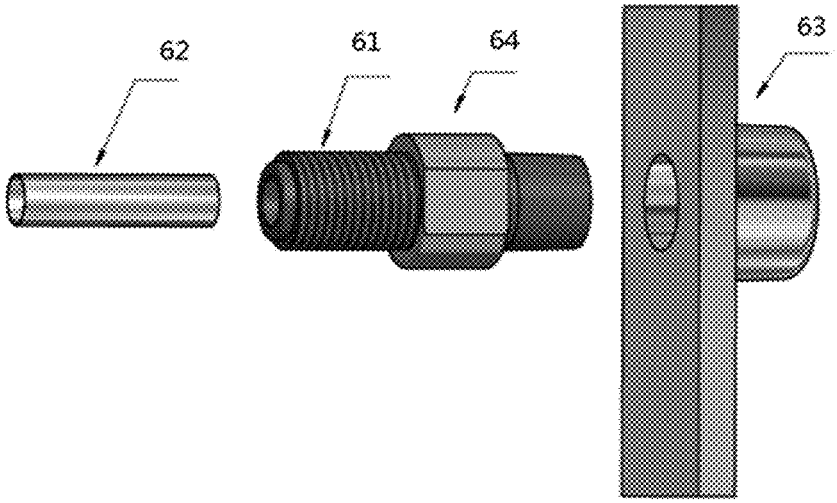
FIG. 6 is a schematic diagram of the unthreaded-hole socket and a detachable nut according to the present invention.

Further, as shown in FIG. 6, which is a schematic diagram of the unthreaded-hole socket, the unthreaded-hole socket comprises a socket body (61) which is arranged with a silver liner welding hole and a screw hole in the inner cavity thereof and an external thread and a conical connecting surface on the outer side thereof; a silver liner (62) is welded in the welding hole, a copper power strip (63) is in plugging connection to the socket body (61) by the conical connecting surface of the socket body, and a detachable nut (64) is connected to the socket body (61) by the external thread; by rotating the detachable nut (64), the conical connecting surface of the socket body could be separated from the connected conical surface; by inserting the plug head of the high-current plug-in connector into the silver liner of the unthreaded-hole socket, the conical connecting section at the plug heel part of the high-current plug-in connector component could be embedded in the silver liner of the unthreaded-hole socket; so that the plugging engagement between the high-current plug-in connector component and the socket body is realized. Specifically, the unthreaded-hole socket is connected to the socket installation insulator through the external thread, and the screw hole is used to realize connection between the unthreaded-hole socket and an electrical device.

Specifically, the socket body (61) is made of pure copper material, and the silver liner is arranged on the inner wall of the welding hole. The silver liner made of pure silver ensures that contact resistance will not increase due to oxidation at the plugging hole after long-term use of the unthreaded-hole socket. As contact between the unthreaded-hole socket and amounting conical surface of the copper power strip is very tight, the unthreaded-hole socket (61) and the copper power strip (63) need to be disconnected by the detachable nut (64).

Figure 7:
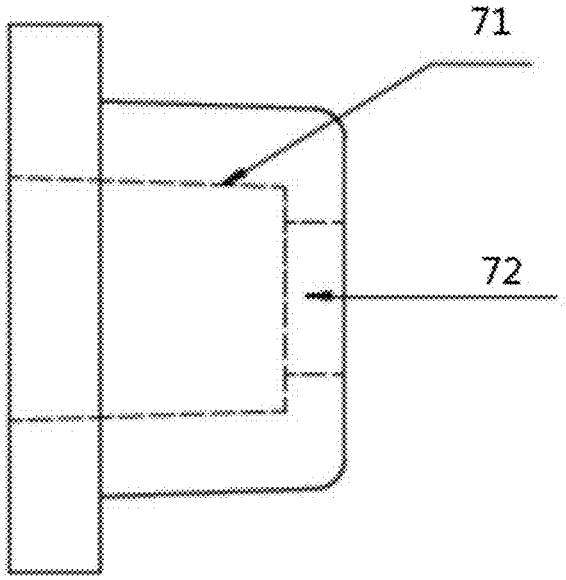
FIG. 7 is a schematic diagram of the copper power strip according to the present invention.

Further, as shown in FIG. 7, which is a schematic diagram of the copper power strip (63) according to the present invention, an inner cavity of the copper power strip (63) is provided with a conical mounting surface (71) and amounting screw hole (72), and the conical connecting surface of the socket body is inserted into the conical mounting surface (71) so that the conical connecting surface of the socket body is embedded onto the conical mounting surface (71) of the copper power strip, thereby realizing the plugging connection between the socket body (61) and the cooper power strip (63). The mounting screw hole (72) coordinates with the screw hole in the socket body (61) so as to realize a thread connection between the threaded-hole socket and an electrical device. Specifically, the conical mounting surface (71) enables conical surface connection between the threaded-hole socket and the cooper power strip (63). Connection between ordinary screws and detachable nuts is actually made by some contact points on contact surfaces, the contact effect is not desirable, and is subject to oxidation and penetration. In the present invention, a conical connection surface is provided on the unthreaded-hole socket for external connection, and conical connection surfaces matches each other accurately; moreover, screws are employed to strengthen the conical surface connection, which amplifies connection pressure by dozens of times, which renders the connection effect far better than that by a common screw and a removable nut.

During implementation, when it is necessary to disassemble the unthreaded-hole socket, first, remove corresponding mounting screws, after that, the unthreaded-hole socket and the copper strip are still tightly connected as a result of the conical surface connection, then turn the detachable nut (64) on the socket body (61) to generate an upsetting force, to separate unthreaded-hole socket and the copper power strip.

Experiments show that, when comparing contact resistance of a high-current plug-in connector according to the present invention whose plug outer diameter is 4 mm with that of an existing fast charging connector whose plug diameter is 12 mm in an electric automobile, connection effect achieved by a 4 mm outer diameter plug body of the high-current plug-in connector according to the present invention is 3 times better than that of 12 mm diameter plug of the existing fast charging connector in an electric automobile, and the biggest current carrying capacity reaches 150 A, which is superior than a current carrying capacity 32 A according to existing technical standards of 4 mm plug diameter plug-in connectors.

Further, comparing with a high-current connector from an international brand, Multi-Contact, the high-current connector from Multi-Contact, with socket ID/B16BV-NS-A, has following performance and dimension data: plug diameter: 16 mm, contact resistance: 25 micro ohm, weight: 792 g, length: 166 mm and outer diameter: 74 mm; whereas, the connector with 4 mm diameter plug according to the present invention has following performance and dimension data: plug diameter: 4 mm, contact resistance: 25 micro ohm, weight: 25 g, length: 40 mm and outer diameter: 25 mm. It is obvious that the high-current connector according to the present invention is superior to the products of Multi-Contact in size, contact resistance, weight and other main indexes.

It can be seen from the above description that use of the high-current plug-in connector according to the present invention can greatly reduce total connection resistance of the entire high-current plug-in connector, increase current carrying capacity, reduce product dimensions, works reliably in a long term and solves the problem that performance of the existing high-current plug-in-in connectors gradually deteriorates over time and contact resistance increases exponentially, thereby endangering the safety of equipment and even personal safety.

The above-mentioned embodiments are only used to illustrate technical solutions of the present invention, but not to limit them; although the present invention has been described in details with reference to the foregoing embodiments, those of ordinary skill in the art should understand that they can still modify the technical solutions described in the foregoing embodiments, or equivalently replace some of the technical features; these modifications or replacements do not depart from the spirit and scope of the technical solutions of the embodiments of the present invention in the essence of the corresponding technical solutions, and should be included in the protection scope of the present invention.

The invention claimed is:

1. A high-current plug-in connector component comprising:

a plug body provided with a center hole and a cable connecting hole in an inner cavity thereof, a silver cap welded to an outer side of an opening of the center hole, a heel part of the plug body, an elastic rubber arranged in the center hole, and a preset soldering tin arranged at a bottom of an inner side of the cable connecting hole, wherein a head of the high-current plug-in connector component is in a plugging engagement with a corresponding plug-in connector component, so that the high-current plug-in connector component is in electrical contact with the corresponding plug-in connector component which is an unthreaded-hole socket; and the center hole is located at a center of the plug of the high-current plug-in connector component, the cable connecting hole is located at a tail end of the plug of the high-current plug-in connector component and used to weld a corresponding cable with the preset soldering tin, so that the high-current plug-in connector component is in electrical contact with the corresponding cable.

2. The high-current plug-in connector component according to claim 1, wherein the plug body is made of pure copper material, the silver cap is made of pure silver material, and the elastic rubber is made of pure rubber material; a diameter of the center hole is half of that of the plug body, and a diameter of the cable connecting hole is the same as that of a copper core of the corresponding cable.

3. The high-current plug-in connector component according to claim 1, wherein a plug end section, a sliver cap welding section, a transition section, an intermediate plug member, the transaction section being between the silver cap welding section and the intermediate plug member, a conical connecting section at the heel part of the plug, a plug reinforcement column member, and a plug tail end member are successively provided along the plug body from the head to the tail end.

4. The high-current plug-in connector component according to claim 3, wherein the silver cap has a hollow structure; a necking section of the silver cap is provided on an outer side of the silver cap, and a welding section is provided in an inner cavity thereof; the welding section is welded to the silver cap welding section at the plug body; after welding is completed, the head of the plug body is slotted into three to six petals, and a diameter of the head of the plug body is appropriately expanded to form an expansion plug.

5. The high-current plug-in connector component according to claim 1, wherein the heel part of the plug is provided with a conical surface, and a diameter of a larger end of the conical surface is bigger than a diameter of a corresponding socket hole, so that the heel part of the plug is in electrical contact with the socket after the plug is inserted into the socket.

6. The high-current plug-in connector component according to claim 1, wherein the elastic rubber is of a solid structure and is successively provided with a head member, a transition part, and a tail member, the transition part being between the head member and the tail member.

7. The high-current plug-in connector component according to claim 6, wherein the unthreaded-hole socket comprises a socket body which is arranged with a welding hole and a screw hole in an inner cavity thereof, and an external thread and a conical connecting surface on an outer side thereof; a silver liner is welded in the welding hole; a conical outer surface at a heel part of the socket body is connected with a conical inner surface at a heel part of the copper power strip (a high current electrode) via at least one bolt; a detachable nut is connected to the socket body by the external thread and by rotating the detachable nut, the conical connecting surface of the socket body is separated from the connected conical surface; by inserting the head of the high-current plug-in connector components into the silver liner of the unthreaded-hole socket, the conical connecting section at the heel part of the plug of the high-current plug-in connector components is embedded in the silver liner of the unthreaded-hole socket, thereby realizing engagement between the high-current plug-in connector component and the socket body.

8. The high-current plug-in connector component according to claim 7, wherein the socket body is made of pure copper material.

9. The high-current plug-in connector component according to claim 7, wherein a mounting conical surface and a mounting screw hole are provided in an inner cavity of the copper power strip, and the conical connecting surface of the socket body is inserted into the mounting conical surface of the copper power strip so that the conical connecting surface of the socket body is embedded in the conical mounting surface of the copper power strip, thereby realizing a connection between the socket body and the copper power strip.

10. The high-current plug-in connector component according to claim 1, further comprising a cable which is welded by the preset soldering tin of the high-current plug-in connector component so as to be electrically connected with the high-current plug-in connector component, and an unthreaded-hole socket which is in a plugging engagement with the high-current plug-in connector component.

* * * * *